US005564866A

United States Patent [19]

Snyder

[11] Patent Number: 5,564,866

[45] Date of Patent: Oct. 15, 1996

[54] REUSABLE MINE AND UNDERGROUND ROOF, FLOOR, AND RIB SUPPORT SYSTEM

[76] Inventor: Raymond M. Snyder, P.O. Box 69, Aurora, Utah 84620

[21] Appl. No.: 419,083

[22] Filed: Apr. 10, 1995

[51] Int. Cl.[6] ..... E21D 11/00

[52] U.S. Cl. ..... 405/288; 405/290; 405/291

[58] Field of Search ..... 405/132, 140, 405/142, 288, 294, 297, 299, 300, 303; 299/33

[56] References Cited

U.S. PATENT DOCUMENTS

| | | | |
|---|---|---|---|
| 4,264,237 | 4/1981 | Irresberger | 405/302 |
| 4,464,084 | 8/1984 | Wozniak | 405/288 |
| 4,505,622 | 3/1985 | Asszonyi et al. | 405/288 |
| 5,156,497 | 10/1992 | Gaskins | 405/291 |
| 5,308,196 | 5/1994 | Frederick | 405/288 |

*Primary Examiner*—Dennis L. Taylor
*Assistant Examiner*—Pamela A. O'Connor

[57] ABSTRACT

A reusable mine and underground roof, floor and rib support system including a horizontal chamber or entry and a tail assembly. The horizontal chamber is composed of individual pieces assembled to form sections of the horizontal chamber which can easily be disassembled and reused. The tail assembly is an individual and separate unit located at the end of the horizontal chamber adapted to accommodate dismantling the horizontal chamber sections using jack and cable winch systems. The combination of horizontal chamber and tail provides a underground entry that will allow roof collapse, floor heave and rib failure and remain usable.

8 Claims, 10 Drawing Sheets

REUSABLE MINE AND UNDERGROUND ROOF, FLOOR, AND RIB SUPPORT SYSTEM

BACKGROUND—FIELD OF INVENTION

This invention relates to the field of devices used to provide roof, floor and rib support in underground applications, especially in mines.

BACKGROUND—DESCRIPTION OF PRIOR ART

Various support devices in the prior art have been designed and used to provide support to the mine roof, floor, and ribs. Deep mining results in the removal of material from the interior of the mine, leaving unsupported voids of various sizes in the mine which may be in danger of collapsing. It is desirable to provide support to the mine roof to prevent or control collapse. It is likewise desirable to provide support to the mine floor to prevent or control floor heave and the ribs to prevent the sluffing off or popping off of material from the ribs. Further, it is desirable for the mine roof, floor, and rib supports to be such that travel within the mine is not unduly restricted, that air flow within the mine remains adequate to support human life and to remove exhaust gases of various machinery in use in the mine as well the gasses occurring naturally within the mine. It is also desirable that the danger of fire in the mine is not increased by the use of supports.

One possible method of mine roof support is to leave internal pillars of rock, coal, ore and other material to support the mine roof. The pillars are material which would normally be removed from the mine but for the need to support the mine roof. This method of support is undesirable because the material which must be left in the mine to form the supportive pillars is usually coal or ore and represents substantial economic value to the mine owner. Further, no support is found for the mine roof, floor or side walls between pillars and there may still be substantial danger of roof collapse, floor heave, or rib deterioration.

Wooden beams or timbers have been used in the past to provide mine roof support. Wooden beams have a serious safety disadvantage in their inability to rigidly support or to yield and absorb load from the mine roof. Instead they have a tendency to snap under load giving way to mine roof collapse. Wooden beams offer no rib support or protection from material popping from the ribs. Wooden beams offer no protection from loose material falling from the roof. Wooden beams are also subject to weakening over time due to decomposition, drying, cracking and splitting. The fire danger within the mine is increased with the presence of wooden beams. Wooden beams supported with wooden posts are also susceptible to the problems stated above.

Wooden posts have been tried as mine supports with varying degrees of success. Single and multiple (ganged) wooden posts of various diameters may be cut to fit between the mine roof and floor. The posts are held tight with wooden wedges and header boards at the top and/or bottom of the posts. These wooden posts are susceptible to the problems listed above and to catastrophic buckling.

Wood cribbing is currently being used in the mining industry. Traditional wood cribbing uses overlapping layers of two or more rectangular wood blocks stacked to the mine roof to form a support which is square in cross section and generally open in the center. The wood blocks may be of various sizes, including standard 8"×8"×48". The advantages of standard wood cribbing over prior wooden supports is its combination of yield range, load support capacity, and stability. Wood cribbing will typically support a mine roof and yield to the compressive forces of the mine roof over a wider range than many other alternative prior art mine roof supports. Typically, wood cribbing structure will buckle when crushed from 20% to 40% of its initial height, if the height to weight ratio is less than two. This results in total loss of support characteristics and can lead to roof collapse, floor heave and ribs deterioration or collapse.

Wood cribbing has been more predictable than many other types of prior art mine roof supports, being less likely to collapse unexpectedly. Wood cribbing, however is subject to weakening over time due to decomposition, drying and cracking or splitting. Wood cribbing requires the use of expensive and sometimes difficult to obtain wood products. Wood cribbing must be assembled from multiple pieces of wood within the mine using costly human labor. Wood cribbing will burn during a mine fire. Wood cribbing does not provide rib support or protection from material popping from the ribs or from loose material falling from the roof. Wood cribbing provides little support for lateral movement between the mine floor and the roof. Lateral movement of the mine roof with respect to the floor can cause wood cribbing to fail allowing total roof collapse. Further, the shape and size of traditional wood cribbing causes some undesirable restriction to both traffic and air flow within the mine. Wood may be replaced by material such as autoclaved aerated concrete and steel mesh to achieve more long term durability and fire resistance, but other problems associated with traditional wood cribbing remain and the cost and difficulty of installation are increased.

Variations of traditional wood cribbing include donut and disc shaped cribbing which comprise multiple donut or disk-shaped members stacked from mine floor to mine roof. Examples of this are Chlumecky (U.S. Pat. Nos. 4,565,469 and 4,497,597) and Duel (U.S. Pat. No. 5,143,484). The stacked donuts or discs are typically made of steel reinforced concrete although it would be possible to construct them from wood or other materials. Concrete discs or donuts do not deteriorate as quickly as wood and will not burn, but they are subject to cracking and crumbling because they are not yieldable over a wide load range. Further the discs or donuts are heavy and require substantial human labor to install. Concrete discs or donuts provide little rib support and offer no protection from loose materials popping from the ribs or falling form the roof. Donut and disc cribbing has the advantage of more readily facilitating traffic and air flow than traditional wood cribbing.

A variation of disc and donut cribbing is the use of a yieldable material placed within a corrugated steel pipe (confined core roof support). An example is Federick (U. S. Pat. No. 5,308,196) This type of roof support uses a corrugated pipe filled with a yieldable material usually a foam or a volcanic pumice with the ends of the corrugated pipe capped to prevent loss of the core material. The core support is placed on wooden cribs with additional wooden cribs and/or wedges placed on top of the confined core to reach the roof. The confined core support has many of the same disadvantages as does the wood cribbing. The wood used in conjunction with the confined core support is susceptible deterioration due to cracking, splitting rotting and increases the potential for a mine fire. The confined core support is large and bulky requiring extensive labor to install. Because of its size the confined core support will substantially reduce traffic and air flow in the mine. The confined core roof support provides little support for lateral movement between the mine roof and the mine floor. The confined core roof support provides no rib support and no protection from materials popping from the ribs or falling from the roof.

An alternative method of cribbing uses telescoping pipe within a material within the pipe to provide yieldable resistance against pressure from the mine roof. An example of this form of roof support is Thorn (U.S. Pat. No. 4,712,947). As pressure from the mine roof increases, a beam, pole or pipe telescopes within another pipe as the material within the pipe is compressed to absorb the load. This type of mine roof support is costly to use in large numbers because of the various custom metal parts which must be employed. this type of mine roof support is also subject to unexpected and severe buckling and collapse when it is stressed beyond the limits of its load range. Further, if wood is employed as a component, there is no reduction of fire danger within the mine.

Roof bolting is a prior art mine roof support presently being used. Advantages to the this prior art form are unrestricted traffic and air flow within a mine and roof bolting does not increase or add to the danger of a mine fire. Roof bolting is best adapted to mines where the constituency of the mine roof is solid. Roof bolting provides little roof support if the roof or ribs consist mainly of loose materials. Roof bolting is subject to sudden and unexpected collapse if the bolts are stressed beyond designed load limits or if the roof consists of loose materials. Roof bolting offers no rib support and will not prevent floor heave or buckling.

These various prior art form roof support systems heretofore known suffer from a number of disadvantages:

(a) All are designed to carry the entire weight of the mine roof to prevent roof collapse.

(b) Each of these prior art support systems is subject to failure from a lateral load and movement of the mine roof in a direction away from or opposed to a stationary mine floor as is common in a longwall mining operation.

(c) These prior art roof supports provide no protection from material popping from the ribs or from loose materials falling from the mine roof.

(d) Once in place these roof support systems are permanent and cannot be removed and/or reused thus subjecting the mine owner to the added expense for new supports upon abandonment of already supported mine sections.

(e) The prior known art forms of roof support which require the use of a wood or a foam material are subject to and can increase the potential of a mine fire.

(f) The prior art roof support systems which require the use of wood or a concrete product are subject to decomposition from rotting, cracking and splitting.

(g) Many prior art roof supports which had ample strength failed due to punching a hole in the roof and/or mine floor.

(h) Many prior art roof supports restrict travel and air flow within the mine.

(i) The prior art mine roof support when used in certain conditions such as a coal mine do not eliminate the need for using rock dust to suppress mine dust.

(j) The prior art mine roof supports for the tailgate entry of a longwall mining operation yield and then collapse at an uncontrolled rate behind the walking shields. This allows the roof to cave unpredictably behind the walking shields. When the supported tailgate entry does not cave directly behind the walking shields of a longwall mining face it can cause the roof over the shields of the longwall closest to the tail gate to cave and dome out above those shields. This problem can result in a roof cave that can destroy those shields or at least stops the mining operation until the void above the shields can be filled with high pressure concrete solution to prevent the roof from caving.

OBJECTS AND ADVANTAGES

Accordingly, besides the objects and advantages of the mine roof, floor and rib support system described in my above patent, several objects and advantages of the present invention are:

(a) to provide a roof, floor and rib support system that will minimize restriction of airflow within the mine, so that air flow within the mine remains adequate to support human life and to remove exhaust gases from machinery working within the mine as well as the gasses occurring naturally within the mine. The preferred embodiment of the invention provides for consistently straight and smooth surfaces free of internal restriction, the least restrictive shape for accommodating air movement from any direction:

(b) to provide a roof, floor and rib support system which eliminates the use of materials subject to decomposition, drying, cracking or splitting and hence weakening over time as some prior art mine roof supports:

(c) to provide a roof, floor and rib support system that will provide protection from materials popping from the ribs and from loose materials falling from the mine roof as the prior art mine roof supports fail to accomplish:

(d) to provide a roof, floor and rib support system which has the structural strength required to support the roof without punching a hole in the roof and/or floor. The invention yields slightly under load and is designed in such a way as to distribute and carry the roof and floor load evenly over a large surface of the invention thus preventing floor heave or buckling as well as roof and rib support. If a section of the invention becomes overloaded it can be temporarily supported with hydraulic or structural supports until the mine roof completely collapses around the invention and the entry becomes self supporting. Prior art mine roof supports rely on use of several individual supports units to support the roof and to prevent floor heave. These prior art roof supports must rely on the mine roof and floor to help support themselves by evenly distributing their weight across the several individual supports. If one of these individual supports fails there is likelihood that other adjacent supports will also fail. If the makeup of the roof and/or floor and/or ribs is of a material of loose or porous composition prior art roof supports are subject to failure. The preferred embodiment of the invention provides for support of roof, floor and ribs in all conditions without relying on the roof, floor or ribs to help support themselves in place:

(e) to provide a roof, floor, rib support system which substantially reduces danger of a mine fire compared to prior art mine roof supports:

(h) to provide for increased safety of mine personnel:

(i) to provide a roof, floor, rib support system which is reusable that can be removed from an abandoned section of a mine and reinstalled in another mine section. The invention eliminates the economical and on-site storage disadvantages of prior art mine roof supports which require the mine owner to continually purchase transport and stockpile. The invention does not require substantial human labor to install. A related economical advantage of the invention is that once the invention is in place it eliminates the costs required by prior art mine roof supports to continually manufacture transport and stock new roof supports:

(j) to provide an exhaust and escape route from a mine such as a tailgate entry for a longwall mining operation. The invention eliminates the possibility of personnel in the mine taking a wrong exit or from getting lost exiting a mine during an emergency such as a fire:

(k) to provide an alternate entry for transporting personnel equipment or material to a section of mine such as longwall mining face:

(l) to provide for a minimum of or eliminate rehabilitation (rehab) work to an already supported mine area. Prior art mine roof support requires extensive rehab from failures due to deterioration or supports, failure of supports, floor heave or buckling, and rib failure. These failures require substantial manual labor to repair with most of the repair materials being transported to the area to be rehabed by hand due to the limited access caused by the failure of the previous roof support system. The repairs to areas where roof supports have failed expose mine personnel to considerable safety risks. The invention eliminates the need for mine personnel to be exposed to these hazardous conditions. The need to rehab a mine section results in added expense for new supports, labor and down time. The invention eliminates these problems:

(m) to provide a mine roof, floor and rib support system that eliminates or reduces the need to rock dust to prevent excessive dusts in the mine atmosphere such as in a coal mine:

(n) to provide a mine roof, floor and rib support system that will allow the roof and/or floor and/or ribs of a mine to completely collapse or fail without compromising the safety of mine personnel while maintaining its original shape and purpose. The preferred embodiment of the invention will allow the roof and ribs to collapse around the invention thereby leaving the invention intact while the collapsed mine debris now surrounding the invention acts as a self support for the mine entry. This collapse relieves the load and associated stresses on the invention. Prior art form roof support systems are designed to keep the roof, floor and ribs in place by supporting the entire load and associated stresses of the mine roof, floor and ribs:

(o) to provide a mine roof, floor and rib support system that will control the rate of collapse of a tailgate entry and relieve the stresses and load associated with prior art roof support systems which had to support the entire weight of the mine roof. This will allow the roof to cave directly behind the walking shields of a longwall mining section preventing the roof of the tailgate entry from caving at too great a distance behind the shields eliminating the doming out of the roof above the walking shields closest to the tailgate entry when the mine roof does not cave directly behind the walking shields.

(p) to provide a roof floor and rib support system for use in applications where material such as concrete or earth fill is placed on top of and around the invention and the invention is later removed leaving a void or passage way through the fill such as a dam.

Further objects and advantages are to provide a reusable safe underground entry by means of a roof, floor and rib support system for use where the roof and/or floor and/or ribs may be in danger of collapse. The invention is designed to eliminate floor heave or buckling and to protect against rib pop. The invention is designed to remain intact and usable in areas that have caved. The invention is designed to provide increased safety for mine personnel. Still further, objects and advantages will become apparent from a consideration of the ensuing description and drawings.

DRAWING FIGURES

Figure 1:
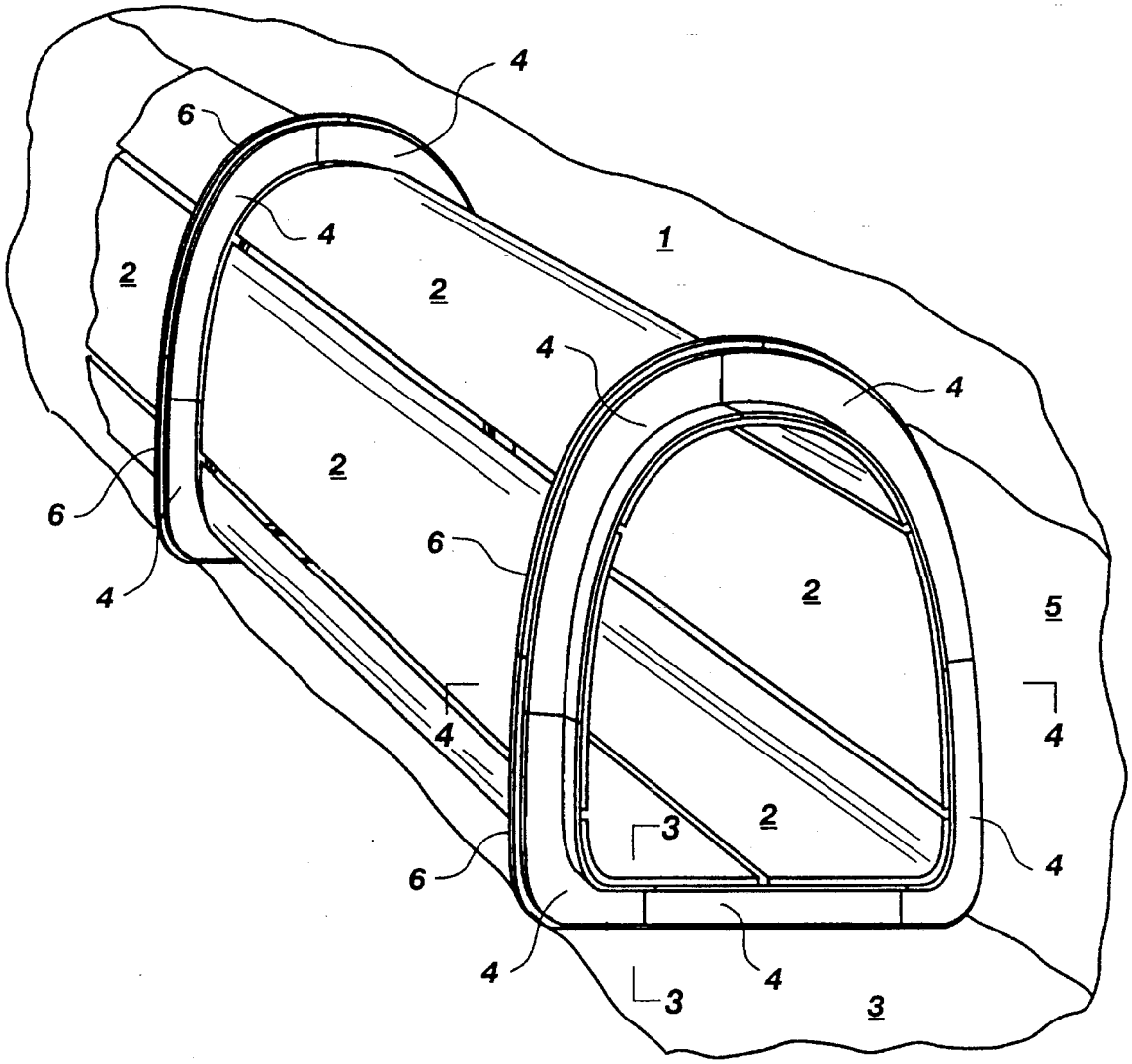
FIG. 1 shows a perspective view of the horizontal chamber in use within an underground mine.

| Reference Numerals In Drawings | |
|---|---|
| 1 mine or underground roof | 2 horizontal chamber panel |
| 3 mine or underground floor | 4 annulus support bent plate |
| 5 mine or underground rib | 6 annulus support angle |
| 8 bolts | 10 tail assembly housing |
| 12 cable winches | 14 pivot pin |
| 16 cable pulley support | 18 openings |
| 20 trolly | 22 jack support assembly |
| 24 jack support pads | 26 cable pulley hook |
| 28 cable pulley | 30 monorail |

DESCRIPTION—FIGS. 1, 2, 3, 4, 5, 6, 7, 8, 9, 10, 11, 12, 13, 14, 15, 16

The invention is called a reusable mine and underground roof, floor and rib support system. It comprises a horizontal chamber and a tail assembly. Referring to FIG. 1 a perspective view of one of the preferred embodiments of the invention in use in an underground mine is depicted. Shown are the horizontal chamber comprised of horizontal chamber panels 2, annulus support bent plates 4, annulus support angles 6, and bolts 8 positioned horizontally along a mine entry comprised of a mine roof 1 and mine floor 3 and mine rib 5. In the preferred embodiment, the horizontal chamber parts are composed of a rigid material such as metal. However the chamber parts can be made of any rigid material of sufficient size and strength to accommodate the load carrying requirements and stresses associated with supporting a mine roof, such as laminated fibrous materials, various plastic materials, polypropylene, graphite or of a composite material.

Figure 2:
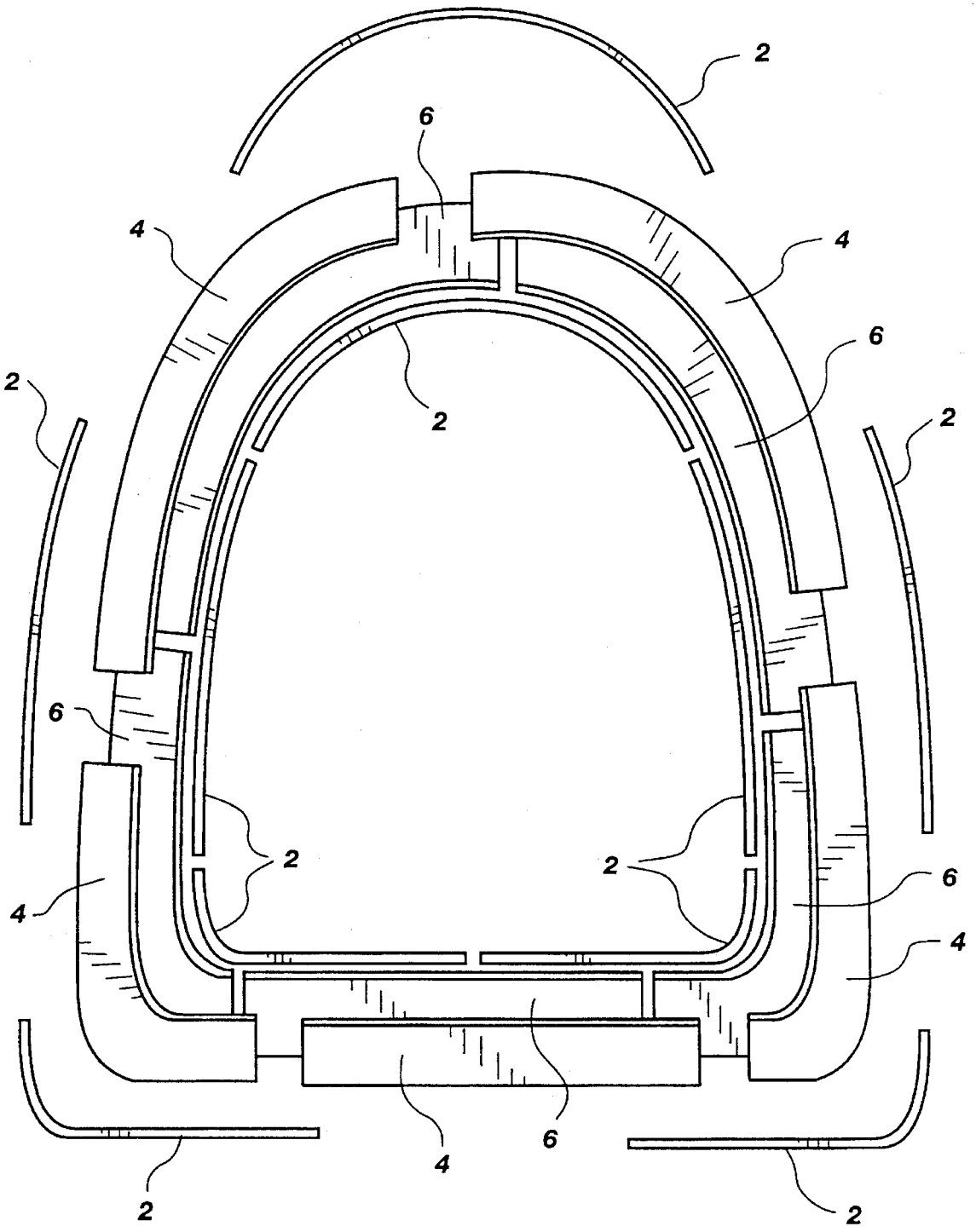
FIG. 2 shows a exploded view of an annulus support and horizontal chamber panels and their relative positioning when assembled.

Referring to FIG. 2 an exploded cross sectional view of the horizontal chamber with one embodiment of the invention having a flat bottom, vertically sloping walls and a doomed top is shown. Also shown is a preferred embodiment of the relationship of assembled parts one to another and the arrangement of the joints or splices of the individual parts which comprise the horizontal chamber. A section of horizontal chamber is comprised of an annulus consisting of annulus support bent plates 4 and annulus support angles 6 bolted together to form an annulus support and of horizontal chamber panels 2 bolted between annulus supports. The joints of individual annulus support bent plates 4 and the annulus support angles 6 are staggered to avoid the placement of one joint on top of another. A preferred embodiment of the splice arrangement for the annulus support would have the placement of joints at ⅓ the distance in from each end of each annulus support bent plate 4 and annulus support angle 6 as depicted in FIG. 2 with each individual member butted together to avoid a space or gap between individual pieces. A preferred embodiment of the joint placement of the horizontal chamber panels 2 with respect to the annulus support would be at the center of the annulus support as depicted in FIG. 2 with the joint or gap between horizontal chamber panels 2 having a predetermined space.

FIG. 2 depicts an embodiment of a horizontal chamber having a flat bottom, vertically sloping walls and a doomed top. However the vertical chamber can be square, rectangular, circular, oval, hexagonal, triangular of a combination of many shapes.

Figure 3:
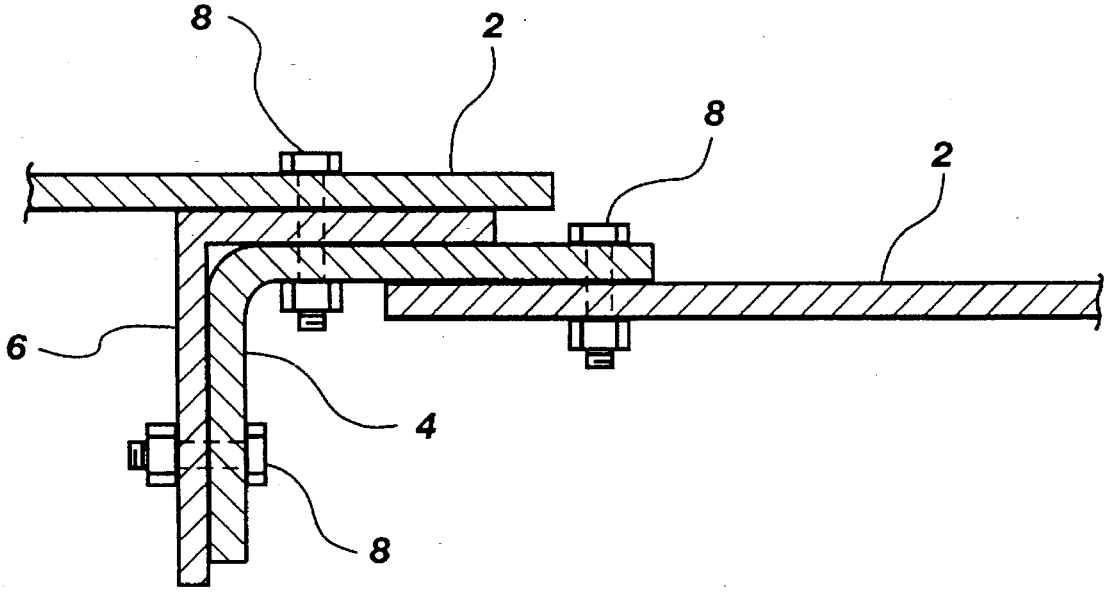
FIG. 3 shows a cross section of an annulus support assembly.

Referring to FIG. 3 a cross sectional view of the horizontal chamber at an annulus support is shown depicting the arrangement of annulus support bent plate 4 and annulus support angle 6 bolted together to form an annulus support, and horizontal chamber panels 2 and bolts 8. Shown in FIG, 3 is a preferred embodiment of the placement of the horizontal chamber panels with respect to the annulus support. This embodiment depicts the leading horizontal chamber panel 2 bolted on the outside face of the annulus support bent plate 2 and the trailing horizontal chamber panel on the inside face of the annulus support and bolted to both the annulus support bent plate 4 and the annulus support angle 6. The trailing horizontal chamber panel 2 is imbricated inside, over and past the annulus support angle 6.

Figure 5:
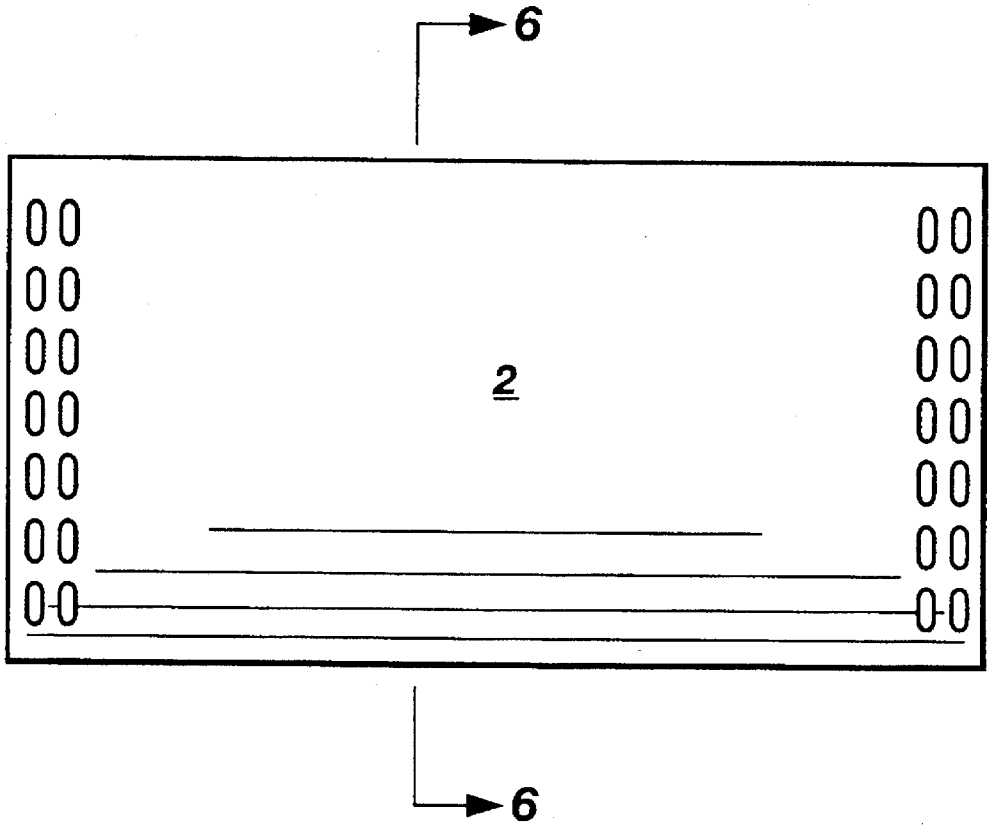
FIG. 5 shows a top view of an horizontal chamber panel.
Figure 6:
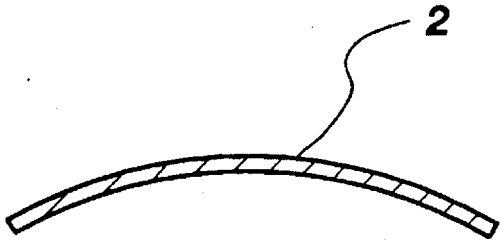
FIG. 6 shows a end view of a horizontal chamber panel.

FIG. 5 depicts a preferred embodiment of a horizontal chamber panel 2 having two rows of slotted holes at each end to allow for proper position bolting of the horizontal chamber panel 2 to the annulus support. FIG. 6 shows and end view of horizontal chamber panel 2.

Figure 7:
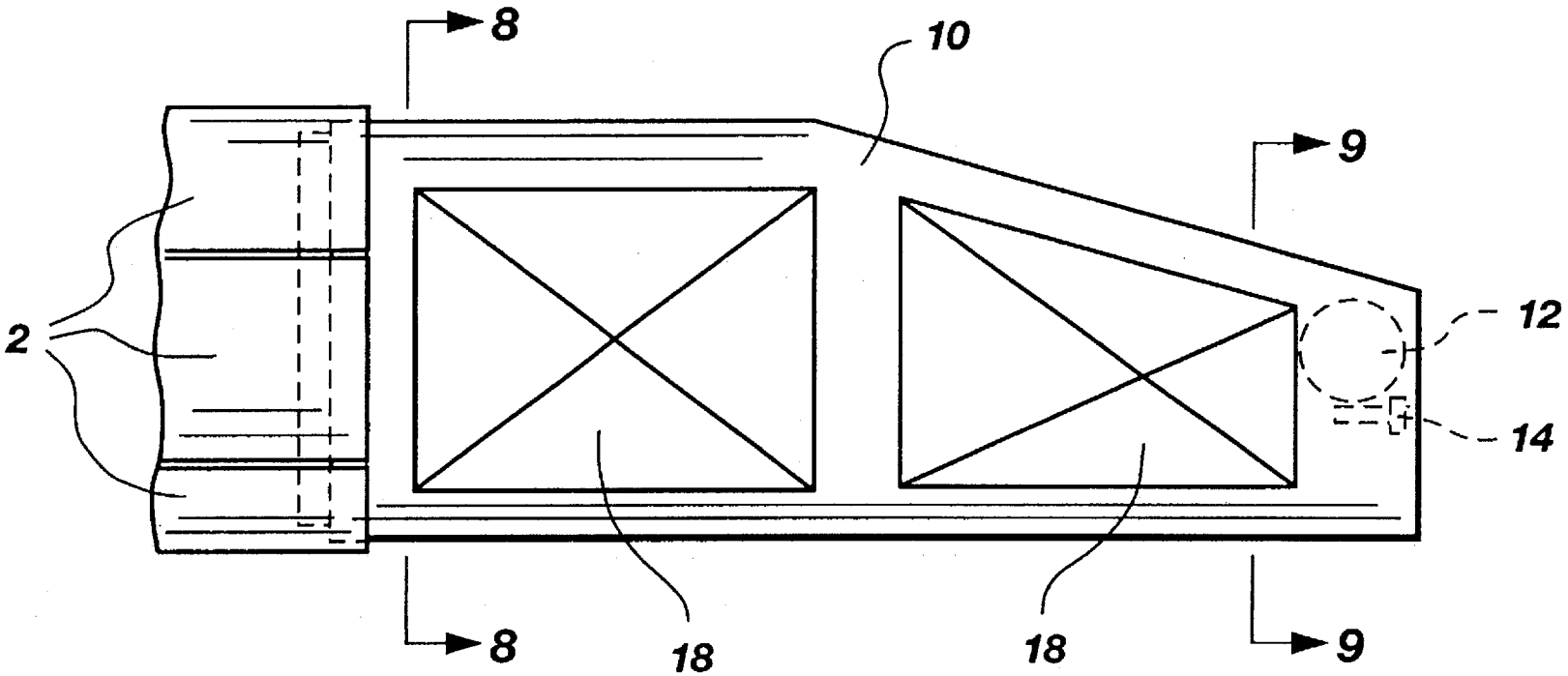
FIG. 7 shows a side view of an tail assembly

FIG. 7 depicts a side view of tail assembly housing 10 imbricated inside the horizontal chamber panels 2 of the horizontal chamber. The tail assembly housing 10 depicted in FIG. 7 has openings 18 in the side to accommodate air flow through the mine and to provide access for mine personnel in a application where the support system is used for a tailgate entry of a longwall mining operation.

Figure 8:
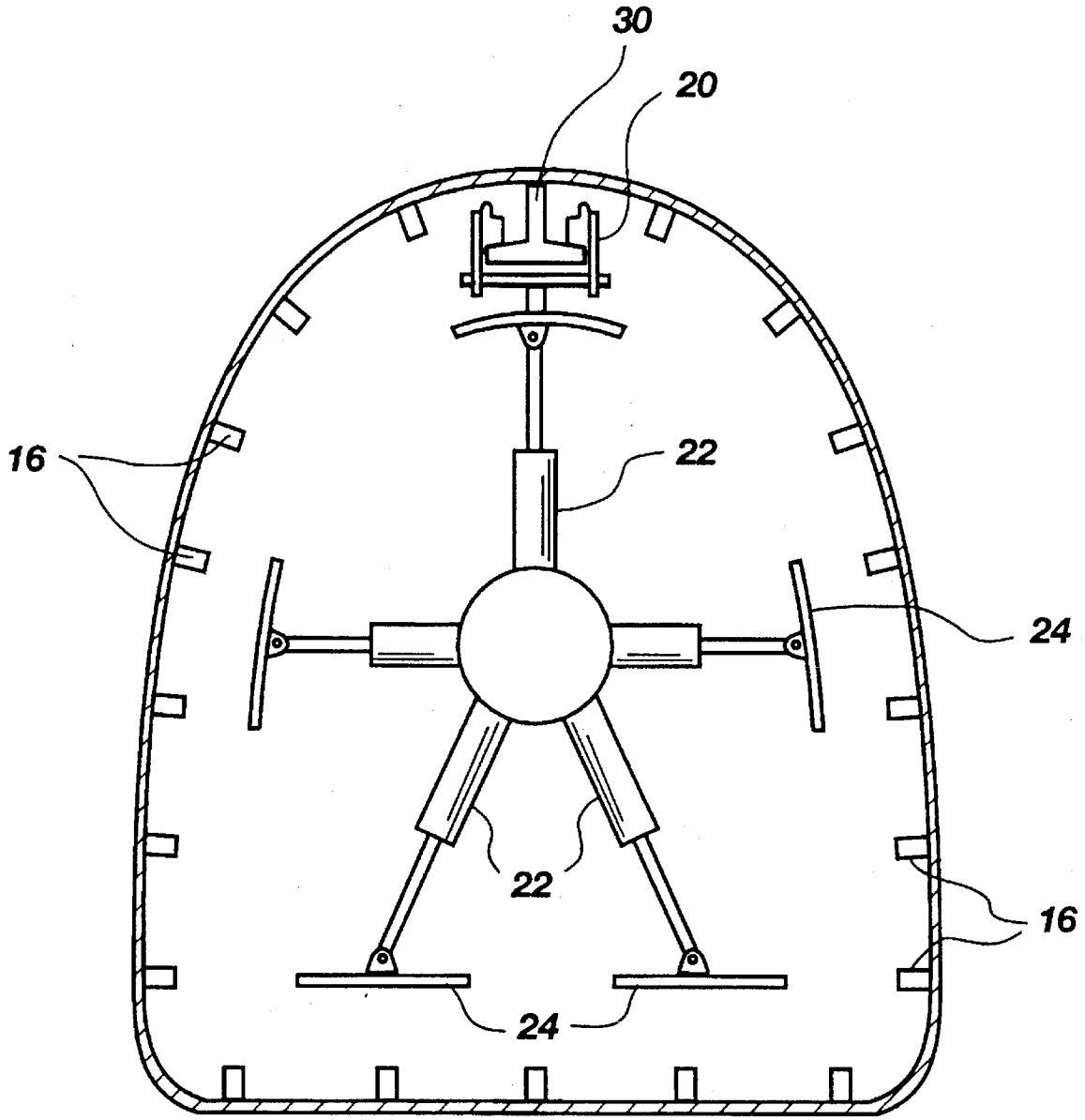
FIG. 8 shows a front view of the tail assembly with the jack support system suspended form a monorail.
Figure 10:
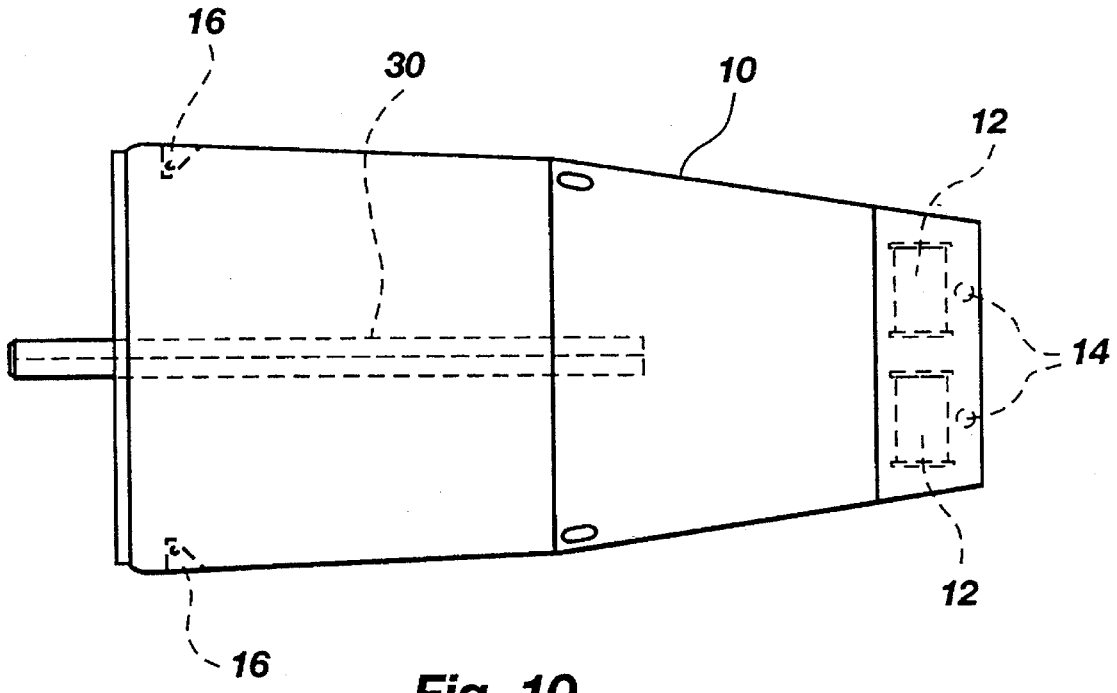
FIG. 10 shows a top view of the tail assembly.
Figure 11:
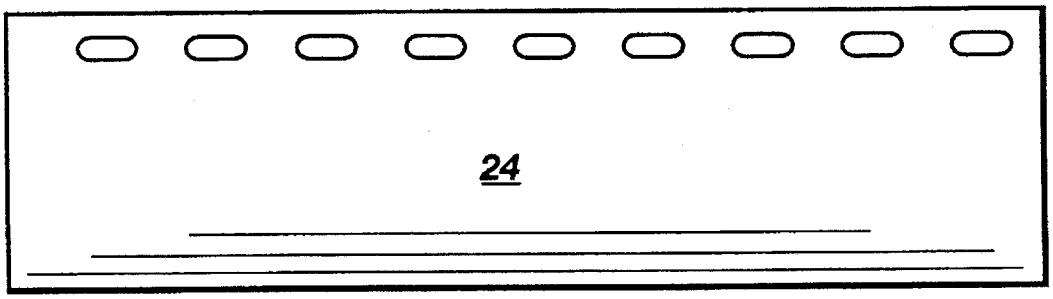
FIG. 11 shows a top view of an support pad of the jack system.

FIG. 8 depicts a cross sectional view of the front end of the tail assembly housing 10 closest to the horizontal chamber. It shows jack support assembly 22 suspended from trolly 20 which transverses monorail 30 located at the top of tail assembly housing 10. Each jack of jack support assembly 22 has a jack support pad 24, also shown in FIG. 11. These jack support pads 24 have slotted holes in one end to accommodate fastening to horizontal chamber panels 2. Monorail 30 extends beyond the front of tail assembly housing 10 as depicted in FIG. 10 to allow the jack support assembly 22 to be moved forward into the horizontal chamber. Once the jack support assembly 22 is moved into the horizontal chamber, the individual jacks of jack support assembly 22 are extended to a position where the jack support pads 24 contact horizontal chamber panels 2. Jack support pads 24 may then be fastened to horizontal chamber panels 2. With the jack support assembly in this position and now supporting horizontal chamber panels 2, the annulus support consisting of annulus support bent plates 4 and annulus support angles 6 can be dismantled.

Figure 9:
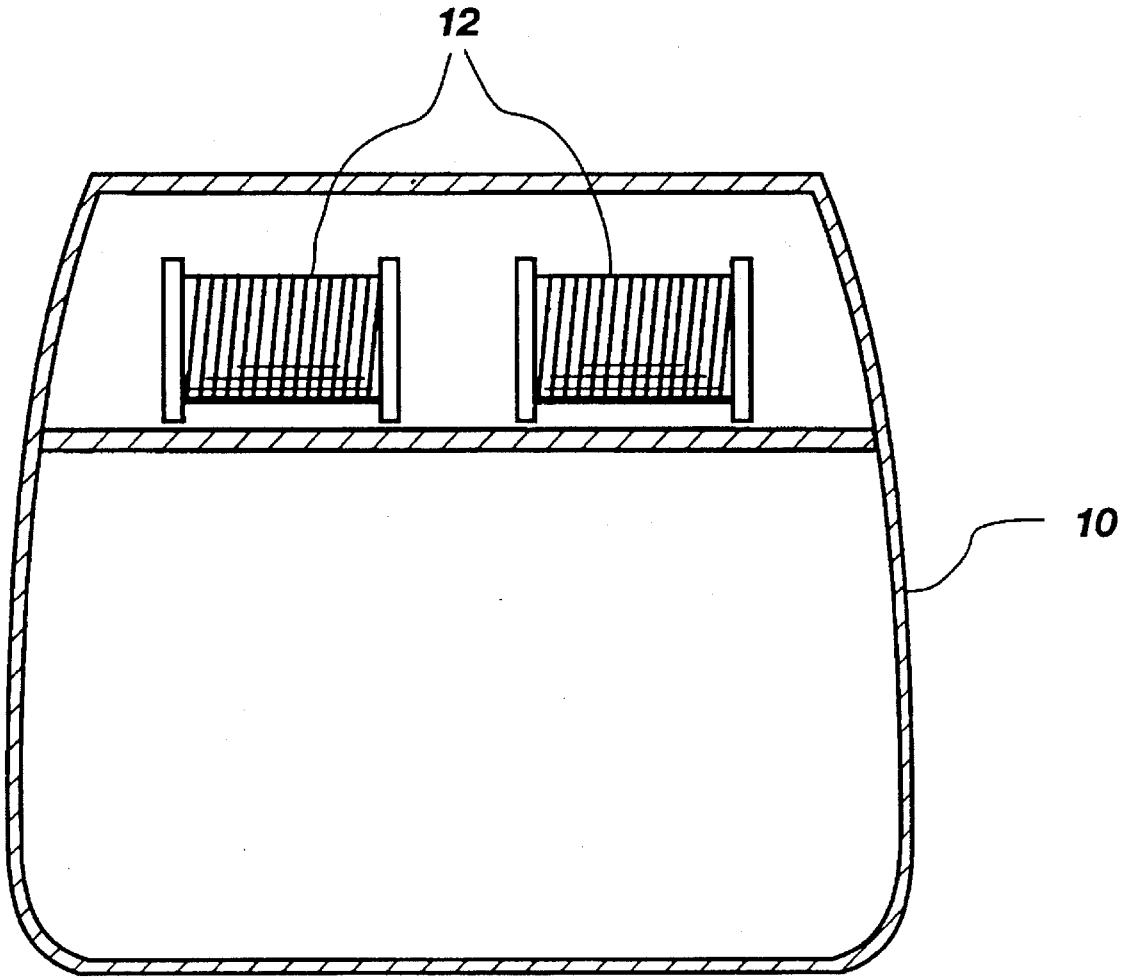
FIG. 9 shows a cross section view of the rear of the tail assembly with the cable hoists.

FIG. 9 depicts a cross sectional view of the rear of tail assembly housing 10 showing the positioning of cable winches 12. Cable winches 12 are also shown in their position at the rear of tail assembly 10 in FIGS. 4, 7 and 10. Cable winches 12 are mounted at the rear of tail assembly 10 using pivot pins 14 which will allow cable winches 12 to turn on pivot pin 14 thus allowing for the cable winches 12 to accommodate pulling from multiple directions.

Figure 4:
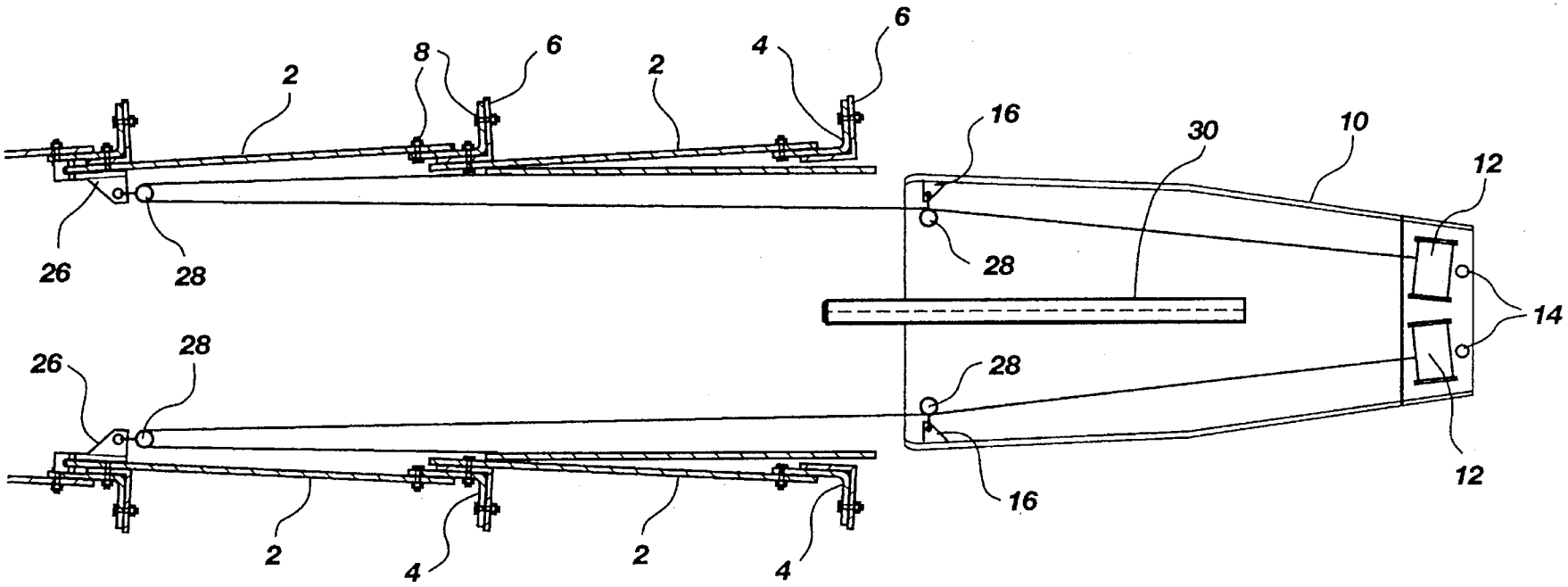
FIG. 4 shows a top longitudinal cross section of the horizontal chamber and tail assembly.
Figure 12:
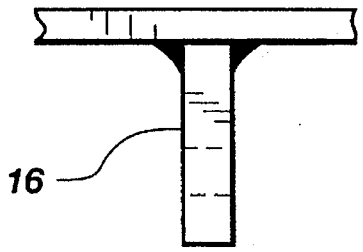
FIGS. 12 and 13 show an front and side view of a cable pulley support located at the front of the tail assembly.
Figure 13:
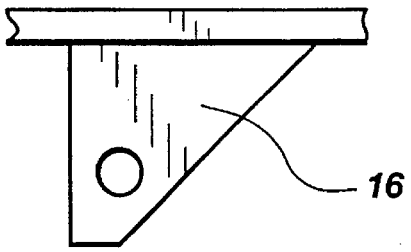

FIG. 10 is top view of tail assembly housing 10 showing the positioning of monorail 30, cable winches 10 and pivot pins 14. The location of cable pulley supports 16 which are attached to tail assembly housing 10 are shown in FIGS. 4, 8, and 10. Referring to FIG. 10, a preferred embodiment showing a multitude of cable pulley supports located around the front of the tail assembly housing 10 is depicted. A preferred embodiment of the shape of cable pulley support 16 is shown in FIG. 12 a front view and FIG. 13 a side view of cable pulley support 16.

Figure 14:
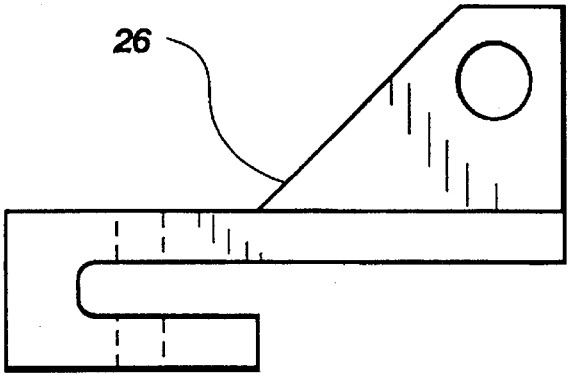
FIG. 14 and 15 show an side and top view of a cable pulley hook used in the horizontal chamber.
Figure 15:
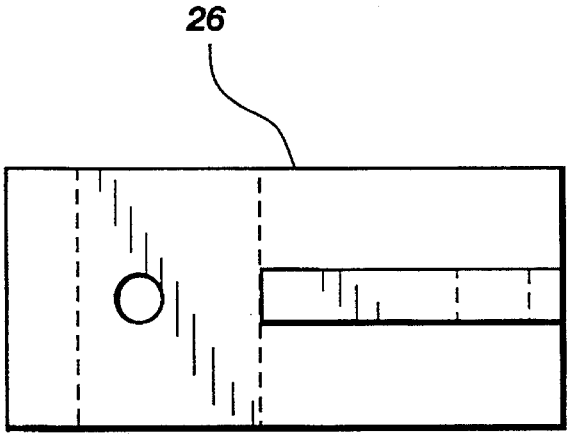

FIG. 14 depicts a side view of cable pulley hook 26 and FIG. 15 depicts a top view of cable pulley hook 26. The preferred locations and use of the cable pulley hooks 26 are shown in FIG. 4. The cable pulley hooks 26 are adapted to hook over and fastened to the front edge of a trailing horizontal chamber panel 2. Cable pulley hook 26 is fashioned to have a cable pulley 28 attached to it as shown in FIG. 4.

Figure 16:
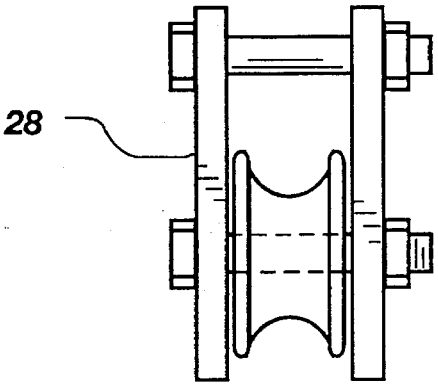
FIG. 16 shows an cable pulley.

FIG. 16 depicts cable pulley 28 which is attached to cable pulley support 16 and to cable pulley hook 26 as shown in FIG. 4, by means of a bolt at the top of cable pulley 28.

From the description above, a number of advantages of my reusable underground and mine roof, floor and rib support system become evident:

(a) The support system can be disassembled and removed from an abandoned section of a underground mine or other underground application and reassembled and used in a new section of a mine or underground application.

(b) The support system will allow for an original mine entry to remain in place or it will accommodate the complete collapse of the original mine entry around the support system.

(c) The support system provides for a mine entry that is considerably safer than existing systems.

(d) The support system allows for better air flow within a mine.

(e) The support system provides an alternate and safe escape route form a mine.

(f) The support system eliminates the need for rehabilitation of a mine roof support system that has failed.

(g) The support system is adaptable to all roof floor and rib conditions.

OPERATIONS—FIGS. 3, 4, 8, 9, 10, 11, 12, 13, 14, 15, 16

The manner of assembling using and dismantling the reusable underground and mine roof, floor and rib support system is best explained using FIG. 4. Referring to FIG. 4, the support system is comprised of a horizontal chamber and a tail assembly.

The horizontal chamber is comprised of annulus supports assembled from annulus support bent plates 4 and annulus support angles 6 bolted together to form a single annulus support as shown in FIG. 3 and horizontal chamber panels 2 bolted between annulus supports as shown in FIG. 3. A preferred embodiment would have parts required to assemble the annulus supports placed on a template and bolted together to insure that each annulus support is typical.

The tail assembly is a preassembled unit consisting of a tail assembly housing 10 containing a jack support assembly 22 suspended from a trolly 20 which travels on a monorail 30 as depicted in FIG. 8, cable hoists 12 mounted at the rear of the tail assembly housing 10 with pivot pins 14, with cable pulley supports 16 and openings 18 to allow entry or exit from the tail assembly housing 10 and to allow for air flow through the support system and thus throughout the mine.

The preferred embodiment of the invention would start with the tail assembly housing 10 imbricated inside the horizontal chamber panels 2 as shown in FIG. 7. From this position in FIG. 7 the tail assembly would be drawn forward to a predetermined distance from the preceding annulus support of the next section using the cable hoists 12. This operation consists of running the cable from the cable hoists 12 through a cable pulley 28 bolted to a cable pulley support 16 at the front of the tail assembly. From here the cable is ran through another cable pulley 28 bolted to a cable pulley hook fastened over a horizontal chamber panel 2 of a forward horizontal chamber section as shown in FIG. 4. The cable is then ran back to the horizontal chamber and fastened to one of the cable pulley supports 16. With this rigging in place, the tail assembly can be pulled into the horizontal chamber to the predetermined distance from the annulus support of the next section.

If the single part cable rigging described above does not have the power required to pull the tail assembly into the horizontal chamber, an alternate rigging system with multiple part cable lines can be used. This multiple part cable rigging is accomplished by the use of addition cable pulleys 28 bolted to the cable pulley supports 16 of the tail assembly and additional cable pulleys 28 bolted to cable pulley hooks 26 fastened over a horizontal chamber panel 2. The cable is than ran through the first cable pulley 28 of the tail assembly to and through the first cable pulley 28 in the horizontal chamber back and through another cable pulley 28 on the tail section and back to cable pulley hook 26 in the horizontal chamber where it is fastened. This comprises a three part cable rigging system. As many parts to the cable rigging can be fashioned in this manner as are required to pull the tail assembly into the horizontal chamber.

Once the tail assembly is located at its predetermined position inside the horizontal chamber, the cable rigging used to pull the tail assembly is disconnected. Now the process of disassembling the horizontal chamber panels 2 surrounding the tail assembly can begin. Referring to FIG. 4, the cables from the cable hoists 12 are ran through cable pulleys 28 at the front of the tail assembly to and through cable pulleys 28 bolted to cable pulley hooks 26 fastened to a forward horizontal chamber panel 2 in the horizontal chamber and back to and fastened to the horizontal chamber panels 2 surrounding the tail assembly. The horizontal chamber panels surrounding the tail assembly are disconnected from the annulus support one by one. Using the single part rigging described above the individual horizontal chamber panels 2 are drawn forward into the preceding horizontal chamber section ahead of the tail section as shown in FIG. 4. If multiple part cable rigging is required to pull the horizontal chamber panels 2 it can be accomplished in the same manner as the multiple part rigging described for pulling the tail assembly.

With all the horizontal chamber panels 2 surrounding the tail assembly removed, the tail assembly is now at a predetermined distance from the next annulus support of the horizontal chamber. At this position the disassembly of the annulus support is undertaken. Referring to FIG. 8, a cross sectional view of the tail assembly showing the jack support system 22 suspended from a trolly 20 and monorail 30. The jack support assembly 22 is positioned forward into the horizontal chamber using the monorail 30 which extends into the horizontal chamber as depicted in FIG. 4. With the jack support assembly 22 inside the horizontal chamber the jacks are extended to a position where the jack support pads 24 contact the horizontal chamber panels 2. The jack support pads 24, (FIG. 11), are attached to the horizontal chamber panels 2. Sufficient force is applied to the jack support system that it becomes a support for the horizontal chamber. Once the horizontal chamber is supported by the jack support assembly 22 the dismantling of the annulus support can begin.

Dismantling of the annulus support requires the removal of bolts 8 from the annulus support bent plates 4, the annulus support angle 6 and the horizontal panels 2 to which the annulus support is fastened. The individual overlapping pieces that comprise the annulus support are unbolted and removed one piece at a time. If the bolts 8 have corroded to a point that it becomes difficult to remove the nuts or if the bolts 8 are in a position making it difficult to remove the nuts, the bolts 8 may be broken from either the nut or head side using an pneumatic air chisel or similar device.

With the annulus support removed and the jack support system still in place and supporting the horizontal chamber panels 2, the tail assembly is pulled forward into the horizontal chamber to a predetermined position as shown in FIG. 7 using the rigging described for pulling the tail assembly. With the tail assembly in its predetermined position, the jack support assembly 22 is released and moved back into the tail assembly. The tail assembly is now the support for the horizontal chamber panels 2 surrounding the tail assembly as shown in FIG. 7. This completes the process of disassembling a horizontal chamber section. Each preceding section is disassembled in a similar manner.

In a preferred embodiment, the invention is used in the longwall tailgate entry of a mine. The support system may be installed in the headgate side (next panel's tailgate) of the longwall mining panel prior to the longwall passing the given point of installation. The support system will insure the entry remains open as the longwall panel advances. Even more important, the support system will hold the entry open when it becomes the tailgate entry of the next longwall panel as mining activity progresses, resisting abutment stresses by supporting the roof, floor and ribs in place and/or allowing the roof, floor and ribs to collapse around the support system. Once the longwall has passed any given support section, on the tailgate side, the support section has performed its function and can be disassembled and reinstalled in the headgate entry ahead of the longwall panel. In other applications, however, the support system may be left in a mine under load for a number of years with no degeneration of performance expected and continually providing roof, floor and rib support to permit traffic to move throughout the mine safely and to allow unrestricted air flow throughout the mine as well.

SUMMARY RAMIFICATIONS AND SCOPE

Accordingly, the reader will see that the reusable mine and underground roof, floor and rib support system of this invention can be easily assembled, can be easily dismantled and reassembled in another application, thus eliminate the need for purchasing new supports. Furthermore, the reusable mine and underground roof, floor and rib support system has the additional advantages that

- it can be adapted for use in mining or construction applications;
- it permits a mine entry to collapse completely around it; and
- it can be temporarily reinforced with additional removable supports from the inside, while an entry is collapsing around, supports that can be removed once the invention is completely surrounded with debris;
- it can be easily adapted from a mining application where the annulus supports are on the outside of the horizontal chamber by modifying the construction of the annulus support members and placing them on the inside of the horizontal chamber;
- it eliminates the need to continually transport and stockpile new supports for an underground mining operation;
- it provides for increased air flow throughout a mine;
- it provides a safe mine entry; and
- it provides a mine support system that eliminates the need for rehabilitation of failed supports.

Although the description above contains many specifications, these should not be construed as limiting the scope of the invention but as merely providing illustrations of some of the presently preferred embodiments of this invention. For example, the support system can have many shapes, such as circular, oval, trapezoidal, triangular, etc.; the size of the support system is optional, and can be determined by the application, etc. Thus the scope of the invention should be determined by the appended claims and their legal equivalents, rather than by the examples given.

I claim:

1. A reusable mine and underground roof, floor and rib support system comprising a horizontal chamber wherein said chamber is composed of staggered sections of annulus supports spaced at predetermined intervals, connected with intermediate overlapping panels, and a tail assembly means drawn behind said horizontal chamber to provide a support for said sections and an accessible, protected area for use while dismantling said annulus supports and said panels of said sections.

2. The support system of claim 1 wherein said horizontal chamber is comprised of a plurality of overlapping members having staggered splices and bolted together to form said annulus supports and with said panels placed between and bolted to opposed sides of said annulus supports with the trailing said panels imbricated inside and over the leading said panels.

3. The support system of claim 2 wherein said horizontal chamber is composed of rigid materials having sufficient size and strength to accommodate the load-carrying capacity necessary to impede a decrease in distance between said mine roof and said mine floor.

4. The support system of claim 2 wherein said horizontal chamber is composed of said rigid materials having sufficient size and strength to allow convergence of said mine roof, mine floor and mine ribs upon and around said horizontal chamber with said horizontal chamber being adapted to support said convergence now surrounding said horizontal chamber.

5. The support system of claim 1 wherein said tail assembly is drawn forward by cable winches mounted at the rear of said tail assembly and with said cable winches also used to draw said panels of a said section being disassembled forward into a preceding said section using a series of cable pulleys attached to said tail assembly and to said preceding sections.

6. The support system of claim 1 wherein said tail assembly has a multiple jack support system for holding said sections in place to allow dismantling of said sections with said multiple jack support being mounted on a mono-rail to allow movement of said jack support from said tail assembly to said section.

7. The support system of claim 1 wherein said tail assembly is composed of said rigid materials having sufficient size and strength to accommodate the load-carrying capacity necessary to impede the decrease off distance between said mine roof and said mine floor.

8. The support system of claim 1 wherein said tail assembly is composed of said rigid materials having sufficient size and strength to allow convergence of said mine roof, said mine floor and mine ribs upon and around said tail assembly with said tail assembly being adapted to support said convergence now surrounding said tail assembly.

* * * * *